US005153369A

United States Patent [19]

Hardt et al.

[11] Patent Number: 5,153,369

[45] Date of Patent: Oct. 6, 1992

[54] SAFE AND ARM DEVICE WITH EXPANSIBLE ELEMENT IN LIQUID EXPLOSIVE

[75] Inventors: Lee R. Hardt; Donald L. Burnett, both of Ridgecrest, Calif.

[73] Assignee: The United States of America as represented by the Secretary of the Navy, Washington, D.C.

[21] Appl. No.: 756,266

[22] Filed: Aug. 30, 1991

Related U.S. Application Data

[62] Division of Ser. No. 591,209, Oct. 1, 1990.

[51] Int. Cl.[5] ..... F42C 15/30; F42C 15/34

[52] U.S. Cl. ..... 102/223; 102/705

[58] Field of Search ..... 102/223, 228, 222, 277.1, 102/247, 248, 250, 477, 478, 705

[56] References Cited

U.S. PATENT DOCUMENTS 2,943,569 7/1960 Wolfe ..... 102/247

3,602,141 8/1971 Sutter et al. ..... 102/305

3,608,493 9/1971 Aske ..... 102/250

3,881,419 5/1975 Bea ..... 102/222

3,919,941 11/1975 Breed et al. ..... 102/250

4,241,660 12/1980 Donovan ..... 102/473

*Primary Examiner*—Stephen M. Johnson

*Attorney, Agent, or Firm*—Stephen J. Church; Melvin J. Sliwka; John L. Forrest, Jr.

[57] ABSTRACT

A safe and arm device, which has an explosive train interrupted by a void to establish a safe condition, has the void filled with a liquid explosive to establish an armed condition. The void may be in a device in which the liquid explosive is motivated by fluid pressure corresponding to free-fall or other velocities. The void may be a chamber portion filled with the liquid explosive by expansion of a bladder. Premature arming may be prevented by forming the explosive liquid from nonexplosive liquids mixed by rupture of a bladder or by melting a solid explosive.

3 Claims, 3 Drawing Sheets

SAFE AND ARM DEVICE WITH EXPANSIBLE ELEMENT IN LIQUID EXPLOSIVE

CROSS-REFERENCE TO RELATED APPLICATION

This application is a division of application Ser. No. 07/591,209 filed Oct. 1 1990.

BACKGROUND OF THE INVENTION

1. Field of the Invention

The present invention pertains to the field of ammunition and explosives. More particularly, the invention pertains to the field of arming devices of the blocking or interrupting type which may be operated by fluid pressure or inertia.

2. Description of the Related Art

Safe and arm devices typically have an explosive train including an element which is displaced from the train to place the device in a safe condition and which is inserted into the train to place the device in an armed condition. The element is, typically, a pellet of explosive mounted in a rotor or slide which is motivated, when conditions are appropriate for arming, to carry the pellet into the train. Since detonation of an explosive typically requires that it be subjected to a shock wave, as from a previously detonated explosive in an explosive train, it is known to provide a safe condition by providing a void in the train, the void being filled by some inert, but shock wave transmitting, material to establish an armed condition.

For safety, economy in construction, and reliability, it is highly desirable that insertion of an element for arming be motivated directly by an environmental condition only existing when arming is required. A typical example is the motivation of a element, such as an abovementioned slide or rotor, by the inertia of the element when a projectile is fired from a gun. However, direct motivation of such an element may not be practical when the environmental condition, such as mild acceleration or a relatively slight pressure change, provides relatively limited force. Although such a lack of force may be overcome by using low friction elements, by using energy stored in springs or batteries, by using electronic sensors and amplifiers, or by using very large inertia or pressure responsive elements, the resulting bulk, expense, and fragility are highly undesirable. Also, it is evident that a safe and arm device actuated by a relatively small environmental change or by stored energy is impracticably dangerous unless stringent precautions are taken to prevent premature arming when a similar change occurs during shipping, handling, or as a result of accident. Even where relatively large environmental forces are available, as from ram air in an air launched missile, safe and arm devices typically sense conditions for arming and assume an armed condition using mechanical or electromechanical devices which are relatively complex and, therefore, are expensive and unreliable and require further complexities to prevent improper arming.

It is known in an underwater ordnance device such as a mine to have an explosive train interrupted by a void and to arm the device by filling the void with water for transmission of a detonation shock wave, the filling typically occurring by gravity when water soluble plugs on the device exterior dissolve subsequent to placement of the device in its intended environment. In such underwater devices, it is apparent that large explosive train elements may be provided to generate a shock wave effective to initiate further detonation despite attenuation by the water, that a substantial length of time is available for dissolving the plugs and filling the void, and that this delay and the use of plugs soluble only in the intended environment provide stringent safety precautions. It is also apparent that such an arrangement using an inert liquid, while practical for underwater ordnance, is impractical in a safe and arm device for use, for example in an air launched missile, where bulk and weight must be minimized and arming must occur in a fraction of a second, or where, as in free-fall ordnance, there is no environmental condition change as substantial and enduring as that from air to undersea emplacement.

SUMMARY OF THE INVENTION

A safe and arm device, which has an explosive train interrupted by a void to establish a safe condition, has the void filled with a liquid explosive to establish an armed condition. The void may be in a manometer-like device wherein the liquid is motivated to move into the void by fluid pressure which may correspond to a predetermined aerial velocity ranging from free-fall to supersonic. Where gravity or an inertia force are not available or do not act in a predetermined direction, the void may be a region of a chamber to which the liquid explosive is transferred by expansion of a bladder or the like in the chamber. The bladder may be inflated by such air or other fluid pressure. Premature arming may be prevented by use of an explosive liquid formed on mixing of nonexplosive liquids, as by rupture of such a bladder containing one of the liquids, or by melting a solid explosive, the melting being by heat generated electrically or pyrotechnically or derived from ram air or from a rocket motor or other propulsion system.

OBJECTS OF THE PRESENT INVENTION

An object of the present invention is to provide a safe and arm device which may be motivated to an armed condition directly and reliably by relatively slight changes in environmental conditions and which reliably remains in a safe condition until other conditions for arming are satisfied.

Still another object is to provide such a device which may be prevented from establishing its armed condition by any one or more of variety of predetermined conditions involving pressure, inertia, or temperature.

Another object is to provide a safe and arm device which has the above advantages and yet is simple, inexpensive, rugged, and compact.

BRIEF DESCRIPTION OF THE DRAWINGS

Other objects, advantages, and novel features of the present invention will become apparent from the following detailed description when considered with the accompanying drawings in which.

DETAILED DESCRIPTIONS

In the following descriptions, it is to be understood that the described embodiments of the present invention are only portions of safe and arm devices which may have a variety of constructions providing electrical, electronic, mechanical, and/or chemical safe and arm arrangements in addition to those of the present invention and that these additional arrangements and those of the present invention may be used in many operating environments including, by way of example only, air or surface launched missiles, bombs, projectiles, and mines with arming and final actuation by a variety of presently well-known or later developed devices adapted to the particular environment. Therefore, the following descriptions and accompanying drawings depict embodiments of the present invention and associated elements of representative operating environments diagrammatically with the scales, relative positions, and details of the depicted elements selected to show the present invention and without mounting and connecting elements which may vary with the particular operating environment and which may of any suitable construction selected by one skilled in the art of ammunition and explosives.

Operating Environment

Figure 1:
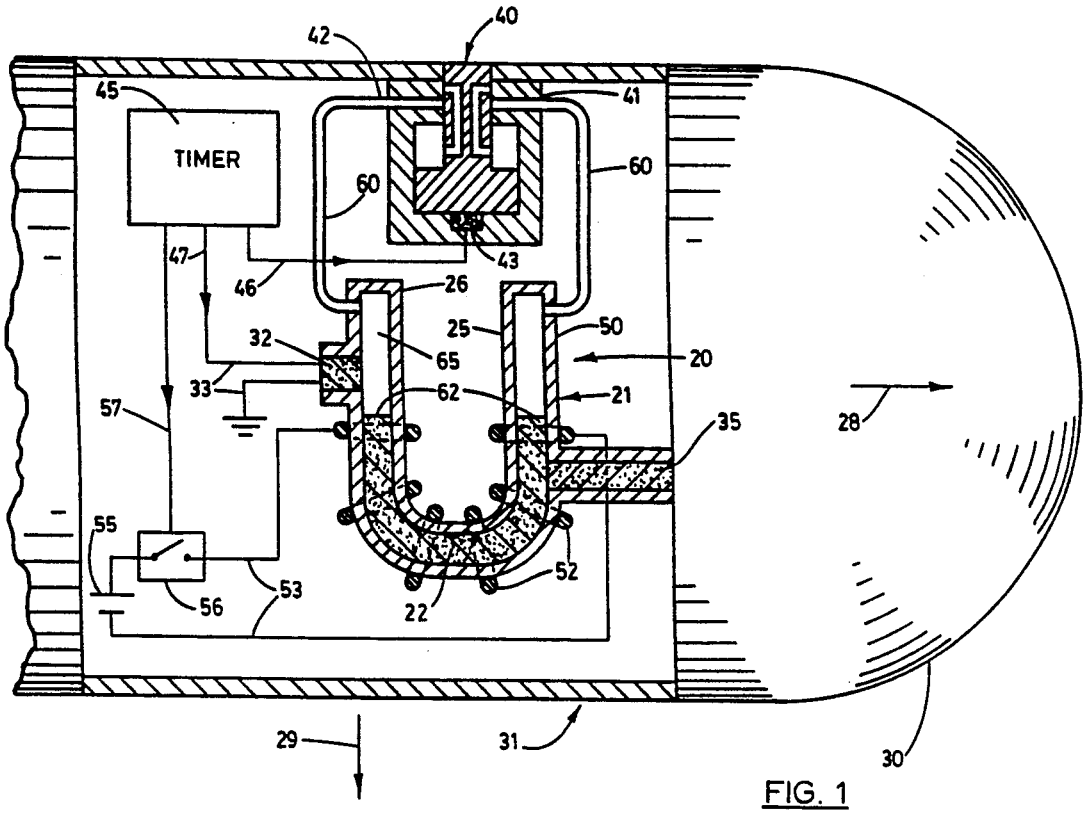
FIG. 1 is a diagram of a first safe and arm device which is in a representative operating environment for the present invention and is characterized by having a manometer, this device being shown in a safe condition.

FIG. 1 shows a safe and arm device 20 which is a representative operating environment of the present invention and is characterized by having a manometer 21 containing a predetermined quantity of an explosive 22. Device 20 is depicted in a representative operating environment of a portion of a missile or the like vehicle. Manometer 21 is a U-tube manometer having opposite arms 25 and 26 subjected to a differential air pressure. However, "manometer" is used in the present application in the general sense of a device having a tube or other enclosure wherein a liquid is displaced by fluid pressure, the displacement being proportional to the density of the liquid and to an acceleration, as from gravity, centrifugal force, or a propulsion system, to which the manometer is subjected. The FIG. 1 missile is adapted to move in air in the direction indicated by arrow 28 while gravity or a comparable centrifugal force acts in the direction indicated by arrow 29.

The FIG. 1 missile portion has a warhead section 30 having an explosive charge, not specifically shown, to be exploded at an appropriate time by a fuze section 31 which includes device 20 and a detonator 32 juxtapositioned to manometer arm 25 and initiated electrically through electrical leads 33 to provide a detonation or shock wave to device 20 for transmission or blocking by the device. A transmitted such wave is provided to warhead 31 from manometer arm 26 through an explosive lead 35 so that manometer 21, detonator 32, and lead 35 are an explosive train. Explosive 22, lead 35, and the charge of warhead section 30 are each composed of a substance which will not explode, that is decompose violently in a detonation wave, unless initiated by another detonation wave which has not been attenuated by passage through a "void", which for purposes of the present application may be the atmosphere or other fluid.

Explosive 22 may be a liquid under all normal conditions, but is preferably any suitable substance having a solid state which can be liquified, as by solvents or heating, to provide an explosive liquid. In particular, explosive 22 may be a substance having a phase which is solid at ambient temperatures and which melts at a predetermined temperature to a liquid phase by the application of heat. It is believed that trinitrotoluene (TNT) which melts at about 80° C. (176° F.), is such a substance well suited for the practice of the present invention.

Fuze section 31 includes a well-known, extensible probe 40 which is depicted in a retracted condition in FIG. 1. Probe 40 has connections 41 and 42 providing a differential pressure corresponding to missile velocity in direction 28. Probe 40 is motivated to an extended position depicted in FIG. 2 by a squib 43. Fuze section 30 includes any suitable timer 45 controlling a representative sequence of events, which bring the missile from an initial safe condition through an armed condition to detonation of warhead 30 and which includes firing squib 43 by a connection 46 and may include initiating detonator 32 by a connection 47. A detonator corresponding to detonator 32 may, of course, be initiated by target impact or proximity or for other reason than elapsed time not relevant to the subject invention.

Manometer 20 with its arms 25 and 26 has a tubular wall 50 which is constructed of any suitable heat conducting material and which is wound exteriorly with an electrical heating element 52 for the quantity of explosive 22. Element 52 is connected through conductors 53 to an electrical energy source 55 and is selectively energizable therefrom, as by a switch 56 controlled by a connection 57 from timer 45, to heat explosive 22 in its solid phase and provide an explosive liquid by melting.

Figure 2:
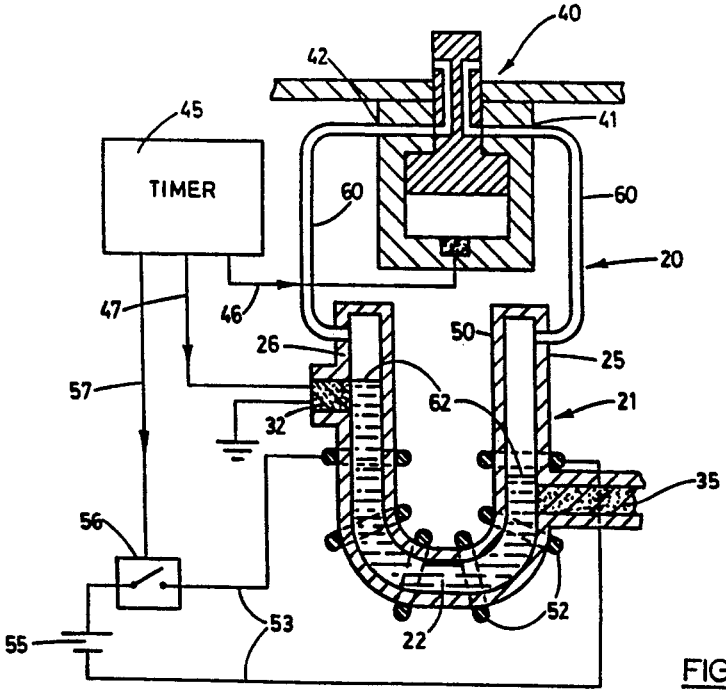
FIG. 2 is a diagram showing the device of FIG. 1 in an armed condition.

Arms 25 and 26 are connected to probe connections 41 and 42 by any suitable conduits 60 so that the differential pressure or pressurized fluid due to a predetermined velocity in direction 28 urges movement of a liquid within wall 50 in opposition to force 29 from a safe position, which is that of explosive 22 depicted in FIG. 1, to an armed position which is that of explosive 22 depicted in FIG. 2 wherein certain elements of the operating environment are omitted for simplicity. Such movement is upwardly in arm 25 and downwardly in arm 26 from the safe position wherein the surfaces 62 of the explosive are at the same level in arms 25 and 26. The quantity of explosive 22 and the respective positions of detonator 32 and lead 35 along arms 25 and 26 are selected so that detonator 32 is disposed along arm 25 at a location thereon which, in the safe condition, is above surface 62 in arm 25 and which, in the armed condition, is below this surface and are selected so that lead 35 communicates with arm 26 at a location which is below surface 62 in arm 26 in both the safe and the armed conditions. It is apparent that tubular wall 50 of manometer 20 defines an enclosure for storing the quantity of explosive 22 in its solid state with the explosive substantially occupying the region in which it is depicted in FIG. 1. It is also apparent that, with explosive 22 in its FIG. 1 safe condition, wall 50 defines within itself a predetermined void region indicated by numeral 65 and disposed where detonator 32 adjoins wall 50. It is evident that region 65 is interposed in the explosive train formed by detonator 32, manometer 20, and explosive lead 35 so as to block passage of a detonation wave from the detonator through the manometer to warhead section 30 and that wall 50 stores the predetermined quantity of explosive 22 at a location spaced from region 65.

At an appropriate time in the operation of a missile having fuze 30 with explosive 22 below its melting temperature and disposed outside of region 65, timer 45 energizes heater 52 which raises the temperature of explosive 22 above its melting temperature to form an explosive liquid, such as the liquid phase of an explosive such as TNT. Timer 45 also fires squib 43 to extend probe 40 and provide to manometer 20 and the liquid explosive therein the above-mentioned differential air pressure corresponding to the missile velocity. When the missile attains a predetermined velocity, which is determined by the relative length of arms 25 and 26, density of the explosive liquid, and the force acting in direction 29 and is a precondition for arming of fuze 30, the differential pressure urges the explosive liquid to be conducted by wall 50 from where explosive 22 is stored, as shown in FIG. 1, toward and into region 65 to establish the armed condition of the explosive train shown in FIG. 2. In this armed condition a detonation wave initiated by detonator 32 is propagated into the explosive liquid which then detonates, thereby amplifying and further propagating the detonation wave through manometer 20 to lead 35 and warhead 30.

It is apparent that device 20 cannot establish its armed condition until explosive 20 is melted by heating element 52. It is also apparent that a device such as manometer 21 may be constructed so that, after melting of an explosive therein, an armed condition may be established by relatively small differential pressure since movement of the explosive liquid in a conduit such as tubular wall 50 is relatively frictionless. Such an armed condition is also established reliably since the differential pressure, which itself is the environmental condition on which arming is to occur, motivates the explosive liquid directly without the interposition of mechanical or electromechanical devices which may fail by not establishing the armed condition when appropriate or may fail dangerously by premature establishment of the armed condition.

First Embodiment

Figure 3:
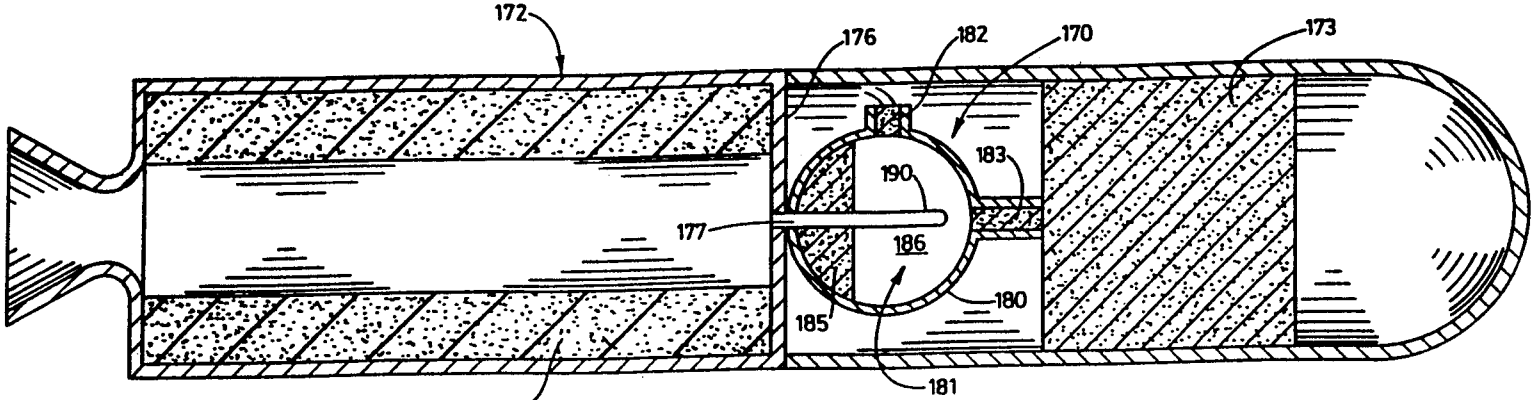
FIG. 3 is a diagram of a safe and arm device embodying the present invention and characterized by having an expansible element, the FIG. 3 device being shown in a safe condition and in a representative operating environment somewhat different from that of FIGS. 1 and 2.
Figure 4:
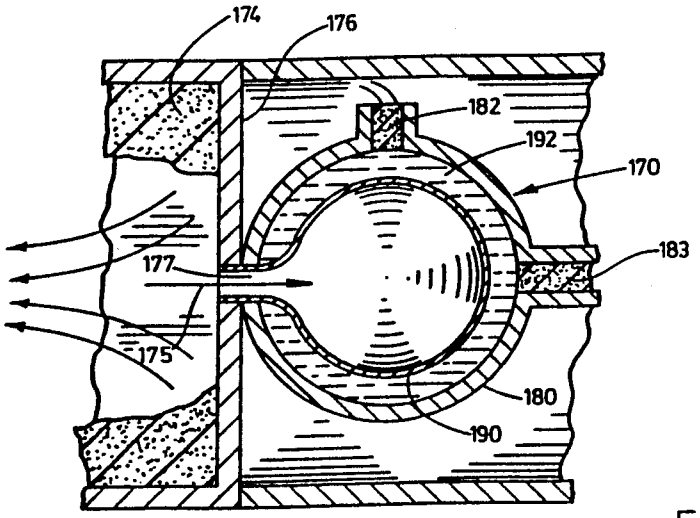
FIG. 4 is a diagram showing the FIG. 3 device in an armed condition.

A safe and arm device 170 embodying the present invention is shown in FIGS. 3 and 4 in a representative operating environment which is a rocket 172 of conventional construction. As shown in FIG. 3, the rocket has a forward warhead portion including an explosive charge 173, has a central fuze portion including device 170, and has a rearward motor or propulsion portion with an exhaust nozzle and a radially centrally burning solid fuel grain 174. FIG. 4 depicts only the fuze portion and an adjacent part of the motor portion has arrows 175 indicating flow of pressurized gas from combustion of grain 174. The motor portion terminates forwardly in a wall 176 adapted to conduct heat from the combustion of grain 174 and this wall has a central orifice 177 for communication of the gas pressure from such combustion so that, for the purposes of the present invention, the motor portion is a heat generating power system and may be considered as a heat and fluid pressure generating pyrotechnic device.

Device 170 has a generally spherical heat conducting wall 180 which engages wall 177 in heat conducting relation and which defines an enclosure 181 in fluid pressure communication through orifice 177 with the motor portion of rocket 172. A detonator 182, which corresponds to FIG. 1 detonator 32, is disposed at one side of enclosure 181, and an explosive lead 183, which corresponds to lead 35, extends forwardly from enclosure 181 to charge 173 so that the enclosure is a portion of an explosive train including detonator 182 and lead 183. A quantity of explosive 185, corresponding to explosive 22, is stored, as shown in FIG. 3, in a solid state within wall 180 and in the rearward region of enclosure 181 toward wall 177. The balance of the enclosure is thus a void 186 which blocks transmission of a detonation wave from detonator 182 to lead 183 and establishes a safe condition of device 170. However when grain 174 burns, explosive 185 is melted by combustion heat transmitted through walls 176 and 180 and the resulting explosive liquid is able to flow into a region of enclosure 181 extending between the detonator and the lead thereby establishing an armed condition of device 170 shown in FIG. 4.

Device 170 has a bladder-like expansible element 190 disposed within enclosure 181 and pressurizable interiorly, through orifice 177 by fluid pressure from combustion of grain 174. Due to such pressure, element 190 expands from a contracted condition thereof, in which the element is depicted in FIG. 3, into an expanded condition of the element depicted in FIG. 4. In the contracted condition, element 190 is disposed centrally of enclosure 181 and does not substantially intrude into either the region thereof occupied by explosive 185 or the region occupied by void 186, thereby providing the void and establishing the safe condition of device 170. However when the explosive is liquified, the expansible element is, when pressurized, free to expand by an increase in volume substantially equal to the volume of void 186 thereby urging the explosive liquid, as shown in FIG. 4, to occupy a peripheral region 192 of enclosure 181, region 192 extending between detonator 182 and lead 183 to establish the armed condition of device 170.

The following is believed evident from FIGS. 3 and 4 and the above description of device 170: Peripheral region 192 is contained in enclosure 181 together with explosive 185 both when this explosive is a liquid, as in FIG. 4. Region 192 is disposed in a predetermined location peripherally within enclosure 181 such that region 192 is substantially void when device 170 is in its safe condition shown in FIG. 3. An explosive train, which is defined by detonator 182, enclosure 181, and lead 183 taken sequentially, contains both region 192 and the predetermined location thereof within enclosure 181. The volume of expansible element 190 expands by substantially the volume of region 192 from the contracted condition of this element in FIG. 3 to the expanded condition of this element in FIG. 4. The contracted condition of element 190 in the safe condition thus results in region 192 being void, and the expanded condition in the armed condition results in region 192 being at its predetermined location in enclosure 181 and being occupied by liquified explosive 185.

It is apparent that a rocket having a device such as device 170 cannot establish an armed condition until the motor portion of the rocket has burned for a long enough time to melt explosive 185 at the same time the motor portion is generating pressurized gas.

Second Embodiment

Figure 5:
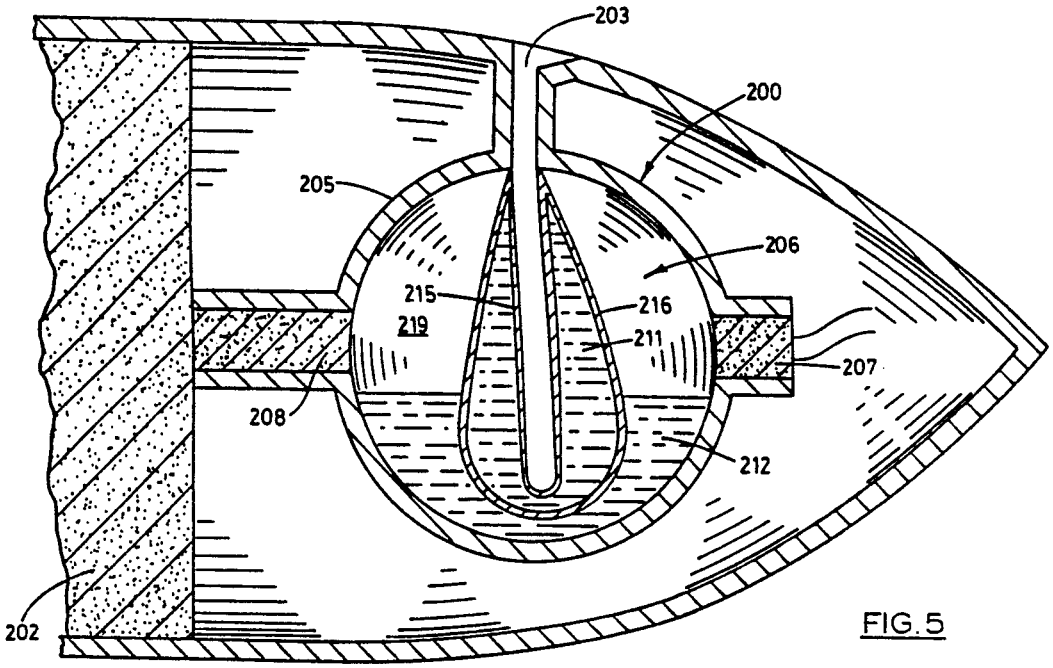
FIG. 5 is a diagram of a another safe and arm device embodying the present invention and characterized by the use of a binary explosive, the FIG. 5 device being shown in a safe condition and in still another operating environment.
Figure 6:
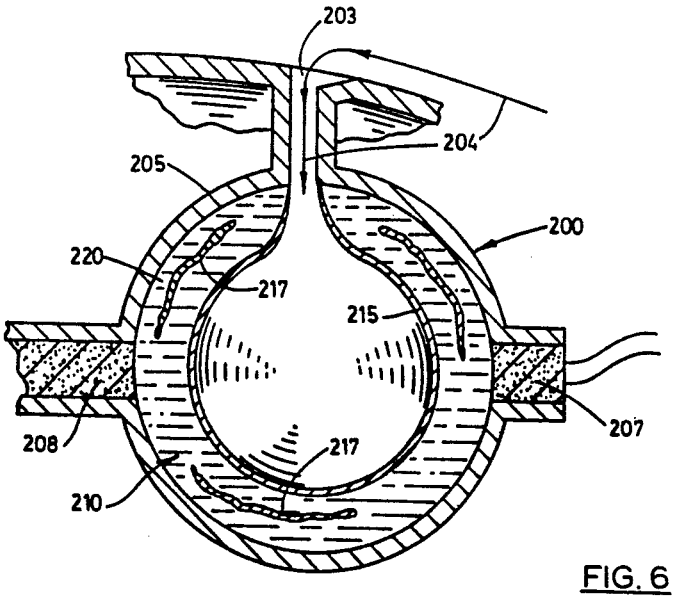
FIG. 6 is a diagram showing the FIG. 5 device in an armed condition.

Another safe and arm device 200 embodying the present invention is shown in FIGS. 5 and 6 in a representative operating environment which is the forward portion of a projectile having an explosive charge 202, parts of the projectile being omitted in FIG. 6. The projectile has an orifice 203 disposed to admit fluid under pressure as indicated in FIG. 6 by arrow 204, this pressure being generated by the velocity of the projectile through air or other medium. Device 200 has a generally spherical wall 205 which defines an enclosure 206 in fluid pressure communication with orifice 203. A detonator 207, which corresponds to FIG. 1 detonator 32, is disposed at one side of the enclosure and an explosive lead 208, which corresponds to lead 35, extends from the enclosure to charge 202. The enclosure is thus a portion of an explosive train including the detonator and the lead.

Device 200 is characterized by the use of a liquid and binary explosive indicated by numeral 210 in FIG. 6 and corresponding generally to explosive 22. Explosive 210 is formed by the mixing of a predetermined quantity of a first precursor liquid and a predetermined quantity of a second precursor liquid, these precursor liquids being indicated in FIG. 5 by respective numerals 211 and 212. Such binary explosives are well-known and are advantageous in that the precursor liquids are relatively inert and do not explode in the above defined sense of decomposition in a shock wave. Liquids 211 and 212 thus attenuate rather than amplify a detonation wave.

Device 200 has a first or inner bladder-like expansible element 215, which is similar to element 190, disposed within enclosure 206 and communicating with orifice 203 to receive fluid pressure 204. This pressure urges element 215 to expand from a contracted condition, in which the element is depicted in FIG. 5, into an expanded condition depicted in FIG. 6. Device 200 has a second or outer bladder-like expansible and also rupturable element 216 disposed within enclosure 206 and surrounding element 215. Element 216 is similar to element 215 in having a contracted condition in which the element is depicted in FIG. 5. However when element 216 is expanded substantially from its contracted condition by internal pressure as subsequently described, element 216 ruptures as indicated by fragments 217 thereof in FIG. 6.

In a safe condition of device 200 shown in FIG. 5, inner expansible element 215 is contracted so as to have substantially no internal volume; first precursor liquid 211 is stored within enclosure 206 between element 215 and outer expansible element 216; and second precursor liquid 212 is stored within enclosure 206 outwardly of element 215 between element 215 and wall 205. The relative volumes of enclosure 206, of liquids 211 and 212, and of outer expansible element 216 in its contracted condition are selected so that the first liquid 211 occupies substantially all of the volume between elements 215 and 216 while the second liquid 212 occupies only a portion of the volume between element 215 and wall 205 so that a void 219 exists within enclosure 206 and element 216 at a region of the enclosure between detonator 207 and lead 208. Void 219, together with the non-explosive nature of liquids 211 and 212, establishes the safe condition of device 200.

However, inner expansible element 215 is, when pressurized through orifice 203, free to expand to its FIG. 6 expanded condition by an increase in volume substantially equal to the volume of void 219 thereby urging the first precursor liquid 211 to rupture outer expansible element 216 and mix with second precursor liquid 212 so as to form the binary explosive liquid 210. Subsequent expansion of the first element by the flow indicated by arrows 204 urges inner element 215 to expand until the volume of void 219 is substantially filled by the explosive liquid which then occupies a peripheral region 220 of enclosure 206. Region 220 extends between detonator 207 and lead 208 and thus establishes the armed condition of device 200 when there exists the environmental condition of the FIG. 5 projectile attaining a sufficient velocity to expand element 215 and rupture element 216.

The following is believed evident from FIGS. 5 and 6 and the above description of device 200: Peripheral region 220 is contained in enclosure 206 together with precursor liquids 211 and 212 when the device is in its FIG. 5 safe condition, and region 220 is contained in the enclosure together with explosive liquid 210 when the device is in its FIG. 6 armed condition. Region 220 is disposed in a predetermined location peripherally within enclosure 206 such that region 220 is substantially coincident with void 219 in the FIG. 5 safe condition. The above-mentioned explosive train, which is defined by detonator 207, enclosure 206, and lead 208 taken sequentially, contains both region 220 and the predetermined location thereof within enclosure 206. The volume of first expansible element 215 expands by substantially the volume of void 219 from the contracted condition of element 215 in FIG. 5 to the expanded condition of element 215 in FIG. 6. The contracted condition of element 215 in the FIG. 5 safe condition thus results in region 220 substantially coinciding with void 219 and, thereby, establishing the safe condition of device 200. However, the expanded condition of element 215 in the FIG. 6 armed condition results in the volume of pressurized fluid 204 interiorly of expanded element 215 eliminating void 219 so that region 220, at its predetermined peripheral location in enclosure 206, is occupied by explosive liquid 210 formed by mixing precursor liquids 211 and 212, thereby establishing the armed condition of device 220.

In a device of the present invention having, as shown in FIGS. 3–6, an enclosure 181 or 206 with an associated detonator 182 or 207 and explosive lead 183 or 208, it is desirable that the lead and detonator be disposed oppositely of the enclosure as depicted in FIGS. 5 and 6 so that a liquid explosive, such as 210, or a solid explosive to be liquified cannot extend between the detonator and the lead in any orientation of the enclosure prior to the event, such as pressurization of bladder 190, that is intended to establish the armed condition of the device.

Obviously, many modifications and variations of the present invention are possible in light of the above teachings. It is, therefore, to be understood that the invention may be practiced within the scope of the following claims other than as specifically described herein.

What is claimed is:

1. A safe and arm device for use in a vehicle providing a pressurized fluid when said device is in a safe condition and when an armed condition of said device is to be established, said device comprising:

an explosive liquid;

an enclosure containing a predetermined region and said explosive liquid, said predetermined region being at a predetermined location in said enclosure when the device is in said safe condition;

an explosive train including said predetermined region and said predetermined location said region being substantially void to establish said safe condition by interrupting progress of an explosion along the train;

an expansible element disposed in said enclosure and having a contracted condition and having an expanded condition, the volume of said element increasing by substantially the volume of said predetermined region from the volume of said element in the contracted condition, and said element being in said contracted condition when the device is in said safe condition thereby providing said predetermined region and establishing said safe condition; and means for applying said pressurized fluid to said expansible element to urge said expansible element into said expanded condition thereby urging said explosive liquid to occupy said predetermined region and establish said armed condition.

2. A safe and arm device for use in a vehicle providing a pressurized fluid when said device is in a safe condition and when an armed condition of said device is to be established, said device comprising:

an explosive liquid formable by mixing a first precursor liquid and a second precursor liquid;

enclosure means for containing said explosive liquid or said first precursor liquid and said second precursor liquid, and a predetermined region disposed at a predetermined location in said enclosure when the device is in said safe condition;

an explosive train including said predetermined region and said predetermined location, said region being substantially void to establish said safe condition by interrupting progress of an explosion along the train;

a first expansible element disposed in said enclosure means and having a contracted condition and having an expanded condition, the volume of said element increasing by substantially the volume of said predetermined region from the volume of said element in the contracted condition, and said element being in said contracted condition when the device is in said safe condition thereby providing said predetermined region and establishing said safe condition;

a second and rupturable expansible element disposed in said enclosure means adjacent to said predetermined region and substantially surrounding said first expansible element, said first precursor liquid being stored in said enclosure means between said first expansible element and said second expansible element, and said second precursor liquid being stored in said enclosure means outwardly of said second expansible element; and means for providing said pressurized fluid interiorly of said first expansible element so as to expand said first expansible element from said contracted condition into said expanded condition, rupture said second expansible element and mix said first precursor liquid and said second precursor liquid and from said explosive liquid, and urge said explosive liquid formed by mixing said first precursor liquid and said second precursor liquid to occupy said predetermined region, thereby establishing said armed condition.

3. A safe and arm device for use with:

a fist binary explosive precursor liquid;

a second binary explosive precursor liquid; and a source providing a pressurized fluid when said device is in a safe condition and is to establish an armed condition, said device comprising:

a wall defining an enclosure;

a detonation initiator disposed at one side of said enclosure;

a detonation receptor disposed oppositely of said enclosure from said detonator initiator;

an inlet for said pressurized fluid into said enclosure, said inlet being disposed at a side thereof spaced between said initiator and said receptor;

an expansible element disposed in said enclosure between said initiator and said receptor;

a rupturable element disposed in said enclosure and surrounding said expansible element;

a quantity of said first precursor liquid disposed between said expansible element and said rupturable element, said rupturable element isolating said first precursor liquid from said second precursor liquid; and a quantity of said second precursor liquid disposed in said enclosure between said wall and said rupturable element, so that:

isolation of said first precursor liquid and said second precursor liquid by said rupturable element establishes said safe condition; and provision of said pressurized fluid through said inlet expands said expansible element so as to establish said armed condition by rupturing said rupturable element for mixing of said first precursor liquid and said second precursor liquid.

* * * * *